United States Patent [19]

DeMeritt

[11] Patent Number: 4,979,491

[45] Date of Patent: Dec. 25, 1990

[54] RADIANT TUBE AND REFLECTOR HANGER

[75] Inventor: Paul A. DeMeritt, Rochester, Mich.

[73] Assignee: Combustion Research Corporation, Rochester Hills, Mich.

[21] Appl. No.: 490,534

[22] Filed: Mar. 5, 1990

Related U.S. Application Data

[63] Continuation of Ser. No. 302,629, Jan. 27, 1989, abandoned.

[51] Int. Cl.[5] ..... F24C 3/04

[52] U.S. Cl. ..... 126/92 B; 126/91 A; 431/328; 431/343; 392/422

[58] Field of Search ..... 126/92 R, 91 R, 92 A, 126/92 B, 92 AC, 85 R, 85 B, 84; 219/347; 431/328, 329, 343; 248/60, 62; 362/217, 255

[56] References Cited

U.S. PATENT DOCUMENTS

| | | | |
|---|---|---|---|
| 2,910,605 | 10/1959 | Hodge | 219/347 |
| 3,014,680 | 12/1961 | Steinbach | 219/347 |
| 3,171,945 | 3/1965 | Meng et al. | 219/347 |
| 3,310,047 | 3/1967 | Budden | 126/92 |
| 3,399,833 | 9/1968 | Johnson | 237/53 |
| 4,266,117 | 5/1981 | Pardue | 219/347 |
| 4,727,854 | 3/1988 | Johnson | 126/92 B |

FOREIGN PATENT DOCUMENTS

| | | | |
|---|---|---|---|
| 3111535 | 2/1982 | Fed. Rep. of Germany | 219/347 |
| 1172091 | 8/1985 | U.S.S.R. | 219/347 |

*Primary Examiner*—James C. Yeung
*Attorney, Agent, or Firm*—Krass & Young

[57] ABSTRACT

A hanger for use in a low intensity radiant energy heating system. The hanger is used both for supporting the emitter tube/reflector assembly and as an air dam to prevent convection currents from flowing along the emitter tube due to temperature changes.

17 Claims, 2 Drawing Sheets

FIG. 1
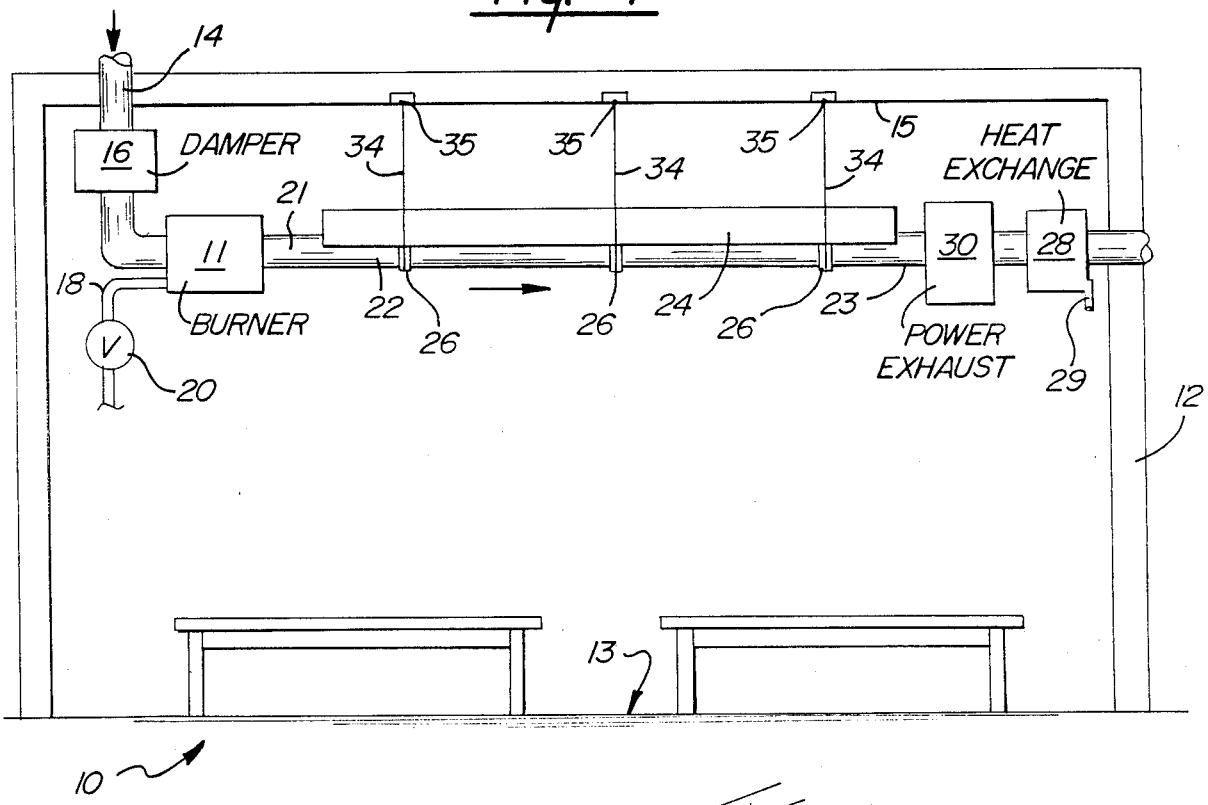
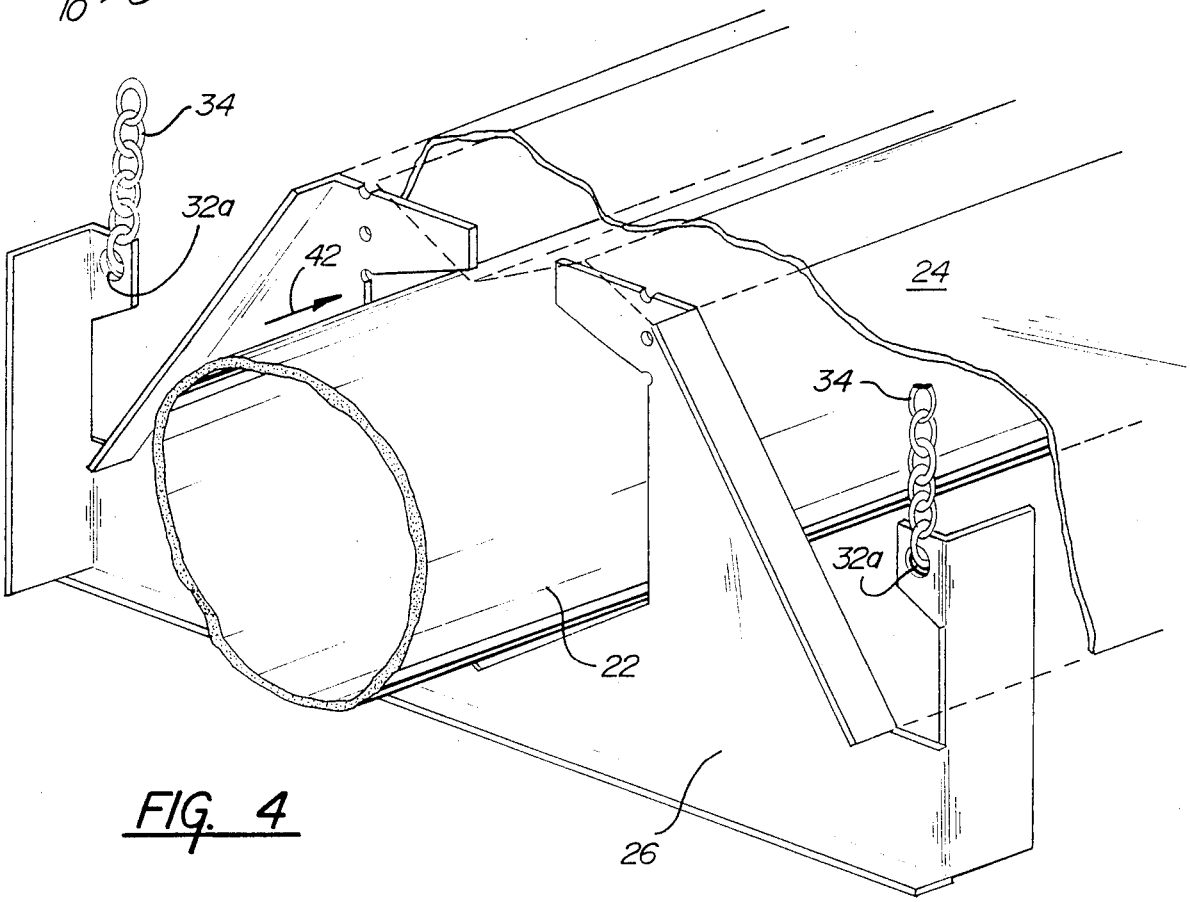
FIG. 4

RADIANT TUBE AND REFLECTOR HANGER

This is a continuation of co-pending application Ser. No. 302,629 filed on Jan. 27, 1989, abandoned.

INTRODUCTION

This invention relates to low intensity, infrared radiant heating systems of the type in which the infrared emitter is a metal tube which is charged with hot gaseous effluent by means of a fuel-fired burner. More particularly, the invention relates to improved support and hanger means for radiant energy heating systems which include tube type emitters and reflectors used in combination.

BACKGROUND OF THE INVENTION

Low intensity, infrared radiant heating systems are preferred over forced air and hot water systems, for example, in many applications. This preference is due in large part to the fact that radiant heating involves direct energy conversion; building mass (concrete floors, machinery, et cetera), persons, plants and animals in the heated areas receive sensible heat via direct energy absorption rather than through the movement of air which has been heated. As a result, people can work comfortably in areas where the actual air temperature is lower than that required for comfort in forced air and convection systems; this, of course, gives rise to substantial energy savings. In addition, a concrete floor under an infrared emitter will absorb energy in the range of frequencies characteristic of radiant tube systems and will thereafter release thermal energy through reradiation to make the enclosure more comfortable for its inhabitants on an economical basis. Such reradiation from the floor warms the feet of the persons working or living in the effected area not only during heating system operation but more importantly afterwards, as well. Infrared systems have the further advantage in greenhouses and the like by positively effecting plant growth rate.

Low intensity infrared systems have further advantages in high directionality capabilities obtainable through the use of reflectors which aim the radiant energy where it is needed the most, thus increasing the effective utilization of the available energy.

A fuel-fired, low intensity radiant energy heating system typically includes a metal tube infrared emitter, the tube being charged with hot gaseous effluent by means of a fuel-fired heated. The system is usually installed with the emitter tube positioned 7 to 50 feet above floor level. Reflectors in the form of light gauge metal fabrications or stampings are installed immediately above the emitter tube over substantially the entire operating length thereof to direct the emitted radiation toward the floor. Typically the entire structure, including the tube, is held together by means of an alloy steel wire hanger which is bent to provide seats for receiving the opposite edges of the reflector. The center portion of the hanger is curved to receive the tube. Wire hangers are placed at regularly spaced intervals along the longitudinal run of the reflector assembly. The alloy steel wire hangers are then connected at their top portions to an overhead structure, such as a ceiling beam or other support, by a chain fastened to the support and, in turn, fastened to the hanger. The alloy steel wire hanger is, essentially, custom bent, resulting in non-uniformity among hangers and increased cost of manufacture.

Convection currents caused by temperature differences along the length of the emitter tube and disturbances within the enclosure actually scrub heat off the emitter tube as the convection current flows from the burner end of the emitter tube to the effluent discharge end. This convection current allows heat to flow along the length of the tube until it reaches the end of the tube where the heat is discharged. This flow of heat along the tube results in a loss of directable radiant heat energy in the needed areas; requiring an increased output by the burner to compensate for the loss. Therefore if the amount of convected heat loss can be reduced, the fuel savings is increased, thus decreasing the operating cost of the system during operation.

SUMMARY OF THE INVENTION

The present invention is directed to overcoming the disadvantages of the prior art noted above. The subject device provides an improved hanger for hanging a radiant tube and reflector heating assembly from an overhead structure. The new hanger may be mass produced, resulting in a uniformity of size and shape unachievable with the old, essentially custom bent hanger. The new hanger further acts as a dam or bulkhead to prevent convection currents from moving along the tube in an "uphill" direction, i.e., from the burner assembly to the effluent discharge.

According to the invention, a rigid member, capable of withstanding the high temperatures developed in the emitter tube without deforming, having first and second ends, an upper surface, a central cutout communicating with the upper surface, and a bearing surface located on the upper surface, is used for hanging and supporting the reflector and radiant tube assembly from an overhead structure. The hanger is of such shape that it cooperates with a cross section of the reflector to form an air dam for preventing convection currents from flowing along the radiant tube.

Another aspect of the invention includes upwardly extending outboard fingers located on the first and second ends of the member, adapted to connect the hanger by a chain or other means to the overhead structure. In another embodiment, the hanger member is configured as a flat plate having end and side flanges used for stiffening and supporting purposes. An additional aspect of the invention includes at least one tab adjacent to the central cutout and proximate the upper surface. The tab or tabs may be bent to allow the hanger to be placed on the radiant tube and afterwards bent back to the original position to retain the tube in the hanger.

In another preferred embodiment, a flat plate configured to have a shape similar to a transverse cross section of the reflector has its outer edges bent at right angles to form stiffening members. By providing the above described tabs to retain the radiant tube in the central cutout, convection currents along the upper surface of the tube and reflector/hanger combination are prevented when the tabs are in the unbent position. The hanger further has upwardly extending outboard fingers which are attached by chain to an overhead structure.

The hanger of the instant invention may be stamped out of sheet metal or other material so as to facilitate mass production of particular sizes in a quick, efficient and accurate manner. Hangers may be prefabricated for specific reflector configurations to prevent convection currents from occurring along the radiant tube.

BRIEF DESCRIPTION OF THE DRAWING

FIG. 1 is a side elevational view of a typical building installation of a radiant tube and reflector heating assembly;

FIG. 4 is an exploded perspective view of a hanger for supporting a radiant tube and reflector combination;

DETAILED DESCRIPTION OF THE PREFERRED EMBODIMENT

Figure 3:
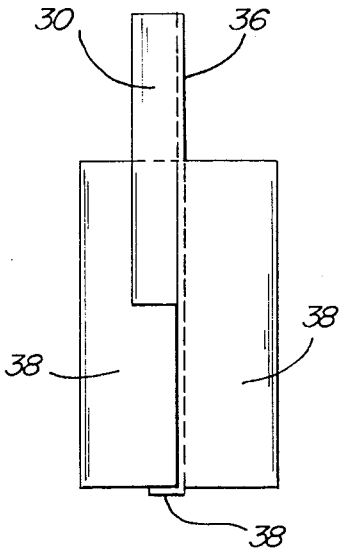
FIG. 3 is a side view of the hanger of FIG. 2.

Referring now to FIG. 1, a low intensity radiant energy heating installation 10 is shown to comprise a gas or oil fired burner 11 located within an enclosure defined by insulated outer walls 12 of a commercial building. The burner 11 is connected through conduit 14 and adjustable damper 16 to the outside of the enclosure to provide air for combination with the gas or oil supplied to the burner 11 through line 18. Line 18 is provided with valve 20 which may be opened and closed by means of an external electrical control signal to emit gas or oil to the burner 11 on demand.

The hot gaseous effluent which is produced by the burner 11 is admitted to the input end 21 of a length of emitter tube 22 preferably constructed of light gage spiral wrapped aluminum, aluminized steel, steel, or coated steel having low thermal inertia and high resistance to corrosion, and rib and seam reinforced for diametrical strength. The length of the tube 22 may vary greatly with the particular installation and, by way of example, the nominal diameter of the tube may be from 2½ to 14 inches. The metal of the tube is preferably from 22 to 31 gage, yielding a weight-to-surface area ratio of one or less. This results in low thermal inertia in the emitter, i.e., heat up and cool down times are short. In contrast, heavy gage welded steel pipes have a weight-to-surface area ratio of between 3 and 6.

Over substantially the entire working length of the emitter tube 22 and in spaced and parallel surrounding relationship thereto is a reflector 24 which directs radiant energy from the tube 22 toward the floor 13 of the building 12. Hangers 26 are suspended from the ceiling 15 of the building 12 to hold the combination of the tube 22, the burner 11 and the reflector 24 in place.

The tube 22 runs and through a power exhaust 30 and a heat exchanger 28 having an acidic condensate drain or trap 29. After passing through power exhaust 30 and heat exchanger 28, the now relatively cool effluent is vented to the atmosphere. The heat exchanger 28 is optional in the system, but where used is preferably constructed of materials, such as plastic or stainless steel, which are highly resistant to corrosion since the function of the heat exchanger is to remove heat from the tube 22 toward the exhaust end 23 and direct it back into the building 12. The gaseous effluent in the tube 22 is preferably cooled to a temperature below the condensation point. Accordingly, an acid drain or trap 29 is necessary so that the condensate may be safely and quickly eliminated from the system. In addition, it is desirable to pitch the cool portion of the system to ensure a flow of condensate to the trap/drain 29.

The power exhaust 30 is also preferably constructed of corrosion resistant materials such as stainless steel. The use of a power exhaust is preferable in most cases to a powered supply system in conduit 14 since the use of power exhaust 30 causes the entire heating system 10 to operate at a negative internal pressure, thus eliminating the possibility of products of combustion flaking into the building 12 through cracks and holes in the tube 22.

Further details of low intensity radiant energy heating system may be found in U.S. Pat. Nos. 3,399,833, 4,716,833 and 4,727,854 all assigned to the assignee of the subject invention, the disclosures of which are incorporated herein by reference.

Figure 2:
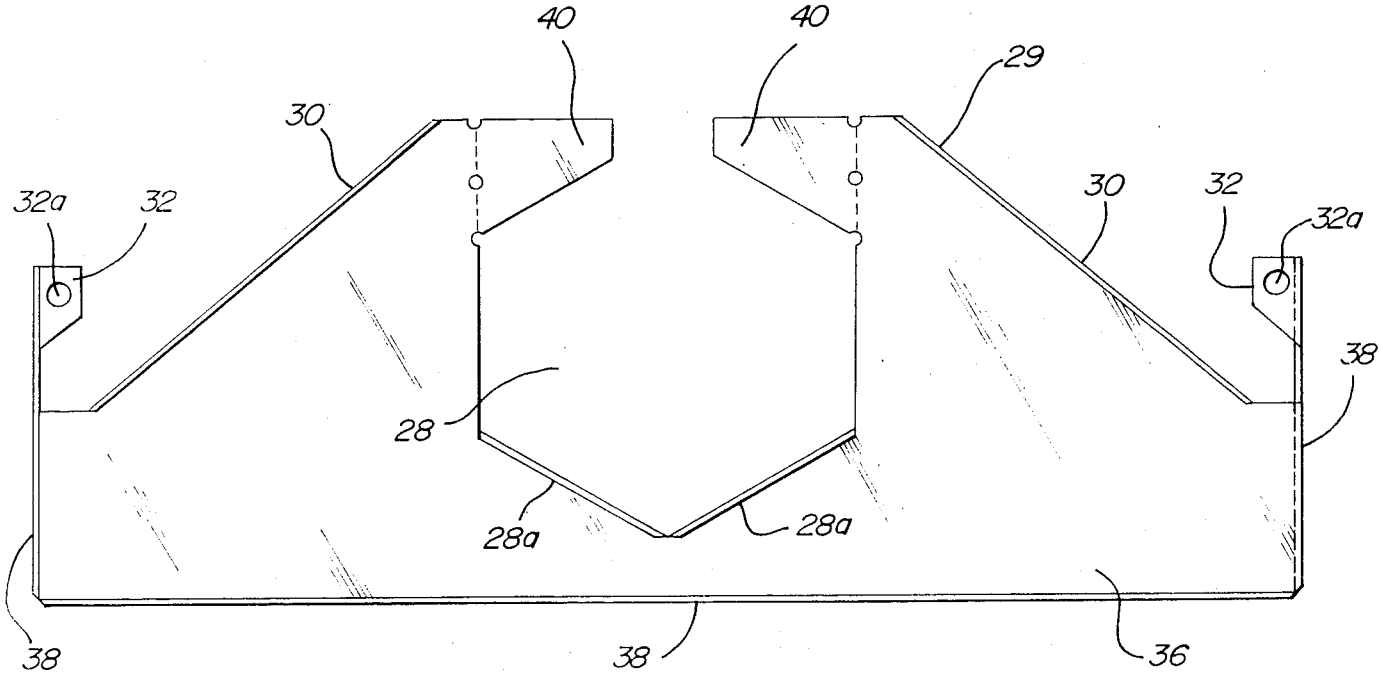
FIG. 2 is a front view of the hanger according to the invention.

FIGS. 2 and 3 illustrate a preferred embodiment of the hanger 26. The hanger 26 is constructed of steel, aluminum or other temperature resistant material capable of withstanding the high temperatures developed within the emitter tube without deforming or losing any structural supporting characteristics. The hanger is generally a trapezoidal configuration of sufficient width and height to substantially surround the emitter tube 22, having an outer configuration similar to a cross section of the reflector 24 transverse its longitudinal direction. The general configuration of the hanger 26 is fabricated as required to fit various shapes of reflectors.

The hanger 26 typically comprises a flat plate 36 having a central cutout 28 for receiving the emitter tube 22. Perpendicular flanges 28*a* are provided to stiffen and reinforce the central cutout 28 and support the emitter tube 22. The upper surface 29 of the flat plate 36 contains perpendicular flanges 30 acting as a bearing surface for the reflector 24. The hanger further includes upwardly extending outboard fingers 32 having holes 32*a* for attaching a chain 34 or other support means, such as a cable or solid hangers. The chain 34 is then attached to an overhead structure or support 35 located on the ceiling 15 of the building 12. The flat plate further has edge flanges 38 located around the periphery of the plate 36 which aid in stiffening and strengthening the plate 36. Tabs 40 are provided on the upper surface of the central cutout 28. Said tabs 40 are bent perpendicular to the plate 36 to enable the operator to insert the emitter tube 22 into the central cutout 28. Once the tube 22 has been inserted, the tabs 40 are then bent back in line with the flat plate 36.

Turning now to FIG. 4, it depicts a hanger 26 used in conjunction with an emitter tube 22 and a reflector 24 hung by chain 34 to an overhead structure 35. As shown, the hanger 26 substantially encircles the emitter tube 22 and conforms to the configuration of reflector 24, thus preventing convection currents due to temperature changes from flowing along the emitter tube 22 in the direction shown by the arrow 42.

Since hanger 26 is made from a flat plate bent and is formed by simple bends, it may be mass produced in a stamping plant. This mass production results in a uniform hangers, which in turn allows quick and efficient installation.

Although a preferred embodiment of the invention has been illustrated and described in detail, it will be apparent to one skilled in the art that various changes may be made in the disclosed embodiment without departing from the scope or spirit of the invention, the true scope of which is defined by the following claims.

I claim:

1. A hanger for hanging a radiant tube and reflector heating assembly from an overhead structure, said hanger comprising:

a temperature resistant member having an upper surface, a central cutout communicating with the upper surface for receiving the radiant tube, and a bearing surface located on the upper surface for supporting the reflector proximate said radiant tube.

2. The hanger as defined in claim 1 wherein said member cooperates with a cross section transverse the length of the reflector to form an air dam, thus preventing convection currents from flowing longitudinally along said tube.

3. A hanger as defined in claim 1 further comprising upwardly extending outboard fingers adapted to connect the hanger to the overhead structure.

4. A hanger as defined in claim 1 wherein said member is configured as a flat plate having flanges formed along the edges thereof for stiffening purposes.

5. A hanger as defined in claim 1 wherein said member includes at least one tab adjacent the central cutout and proximate the upper surface, said at least one tab being displacable from a first position to allow the hanger to be placed on the tube to a second position to retain the tube in the hanger.

6. A hanger as defined in claim 4 having a generally trapezoidal configuration.

7. A hanger as defined in claim 1 wherein the central cutout further includes stiffening members formed on the circumference thereof.

8. A hanger as defined in claim 7 wherein the stiffening members comprise perpendicular flanges integral with the temperature resistant member.

9. A hanger as defined in claim 4 wherein the flat plate is formed of sheet steel.

10. A hanger as defined in claim 4 wherein the flat plate is formed of sheet aluminum.

11. A hanger as defined in claim 4 wherein the flat plate is produced by stamping from sheet metal.

12. For use in a radiant tube/reflector heating system, a tube and reflector support member comprising:

a solid plate of rigid, temperature resistant material having a central cutout configured to receive and support a radiant tube;

an upper perimeter configured to receive and support the reflector over and spaced from the tube; and said solid plate cooperating with a cross section transverse the length of the reflector to from an air dam, thus preventing convection currents from flowing longitudinally along said tube.

13. An apparatus as defined in claim 12 wherein the plate further includes integral laterally hanger support extensions.

14. An apparatus as defined in claim 12 wherein the plate includes flanges formed along the edges thereof for stiffening purposes.

15. An apparatus as defined in claim 12 wherein the plate includes at least one tab, adjacent the central cutout, being displaceable from a first position to allow the hanger to be placed on the tube to a second position to retain the tube in the hanger.

16. An apparatus as defined in claim 12 wherein the central cutout further includes stiffening members formed on the circumference thereof.

17. An apparatus as defined in claim 12 having a generally trapezoidal configuration.

* * * * *